US006044784A

United States Patent [19]

Gee et al.

[11] Patent Number: 6,044,784

[45] Date of Patent: Apr. 4, 2000

[54] MARINE VESSELS

[75] Inventors: Nigel Ian Gee; Edward Robertson Peter Dudson, both of Southampton, United Kingdom

[73] Assignees: Nigel Gee and Associates Limited, Southampton, United Kingdom; Norasia Services SA, Fribourg, Switzerland

[21] Appl. No.: 09/043,523

[22] PCT Filed: Sep. 19, 1996

[86] PCT No.: PCT/GB96/02313

§ 371 Date: Mar. 18, 1998

§ 102(e) Date: Mar. 18, 1998

[87] PCT Pub. No.: WO97/10988

PCT Pub. Date: Mar. 27, 1997

[30] Foreign Application Priority Data

| | | | |
|---|---|---|---|
| Sep. 20, 1995 | [GB] | United Kingdom | 9519243 |
| Dec. 12, 1995 | [GB] | United Kingdom | 9525384 |
| Jun. 19, 1996 | [GB] | United Kingdom | 9612810 |

[51] Int. Cl.[7] ..... B63B 3/00

[52] U.S. Cl. ..... 114/61.15; 114/283

[58] Field of Search ..... 114/61.1, 61.15, 114/61.16, 61.17, 61.18, 61.19, 61.26, 283

[56] References Cited

U.S. PATENT DOCUMENTS

| | | | |
|---|---|---|---|
| 2,585,599 | 2/1952 | Tchetchet | 114/61 |
| 3,085,536 | 4/1963 | Teetor | 114/61 |
| 3,265,026 | 8/1966 | Hamilton | 114/61 |
| 3,296,992 | 1/1967 | Lanckenby | 114/61 |
| 3,847,103 | 11/1974 | Takeuchi | 114/61 |
| 3,871,317 | 3/1975 | Szpytman | 114/61 |
| 5,178,085 | 1/1993 | Hsu | 114/61 |
| 5,235,925 | 8/1993 | Farrier | 114/61 |
| 5,277,142 | 1/1994 | Conor | 114/61 |

FOREIGN PATENT DOCUMENTS

| | | |
|---|---|---|
| 495722 | 7/1992 | European Pat. Off. . |
| 648668 | 4/1995 | European Pat. Off. . |
| 8700135 | 1/1987 | WIPO . |
| 9307046 | 4/1993 | WIPO . |

*Primary Examiner*—Jesus D. Sotelo
*Attorney, Agent, or Firm*—Baker Botts L.L.P.

[57] ABSTRACT

A marine vessel comprises at least one hull stabilized by at least one pair of outboard sponsons and propelled by propulsion means carried by the sponsons or hull. One aspect of the invention is shown in FIG. 7, where a marine vessel (20) is provided with first second pairs of outboard sponsons (230, 231), with the first pair (230) disposed forwardly of the second pair (231). The sponsons (230) of the first pair are disposed at a higher level than the sponsons (231) of the second pair. At the load water line (208) of the vessel, the sponsons (231) of the second pair are in contact with the water while the sponsons (230) of the first pair are disposed above the waterline (208). As shown in FIG. 12, should the vessel (201) heel to one side, the sponson (230) of the first pair on the heeling side of the vessel is brought into contact with the water, so as to create an upwardly acting restoring force (250) which tends to stabilize the vessel. Other aspects of the invention are disclosed.

18 Claims, 8 Drawing Sheets

MARINE VESSELS

BACKGROUND TO THE PRESENT INVENTION AND SUMMARY THEREOF

This invention relates to marine vessels.

EP-A-0 495 722 discloses a marine vessel comprising a central hull stabilised by first and second pairs of outboard sponsons and propelled by propulsion means carried by the sponsons or the hull, the first pair of sponsons being disposed forwardly of the second pair of sponsons, the sponsons of the first pair being disposed at a higher level than the sponsons of the second pair, so that, at zero heel angle, at the load water line of the vessel, the sponsons of the second pair are in contact with the water while the sponsons of the first pair are disposed above the water.

The present invention relates to such a marine vessel, characterised however in that, at zero heel angle, the waterline breadth of each sponson of the second pair of sponsons is greater than the draft thereof, and that should the vessel heel to one side, the sponson of the second pair on the downgoing side of the vessel dips deeper into the water, while the other sponson of the second pair which is on the upgoing side of the vessel emerges from contact with the water, and the sponson of the first pair on the downgoing side of the vessel is simultaneously brought into contact with the water, so as to stabilise the vessel.

The hull may have a waterline length to beam ratio greater than 6 and preferably 10.

The vessel may be provided with first and second pairs of outboard sponsons, with the first pair disposed forwardly of the second pair, the sponsons of the first pair being disposed at a higher level than the sponsons of the second pair so that, at the load water line of the vessel, the sponsons of the second pair are in contact with the water while the sponsons of the first pair are disposed above the water whereby, should the vessel heel to one side, the sponson of the first pair on the heeling side of the vessel is brought into contact with the water, so as to create an upwardly acting restoring force which tends to stabilise the vessel.

The sponsons of each pair of first and second sponsons may be spaced from each other longitudinally of the vessel.

The sponsons of each pair of first and second sponsons may be combined so as to form a single integral structure of stepped form.

BRIEF DESCRIPTION OF THE ACCOMPANYING DRAWINGS

The various aspects of the invention will now be described by way of example only with reference to the accompanying drawings, wherein.

In the figures, like reference numerals refer to like structures and features.

DETAILED DESCRIPTIONS OF THE PREFERRED EMBODIMENTS

Figure 1:
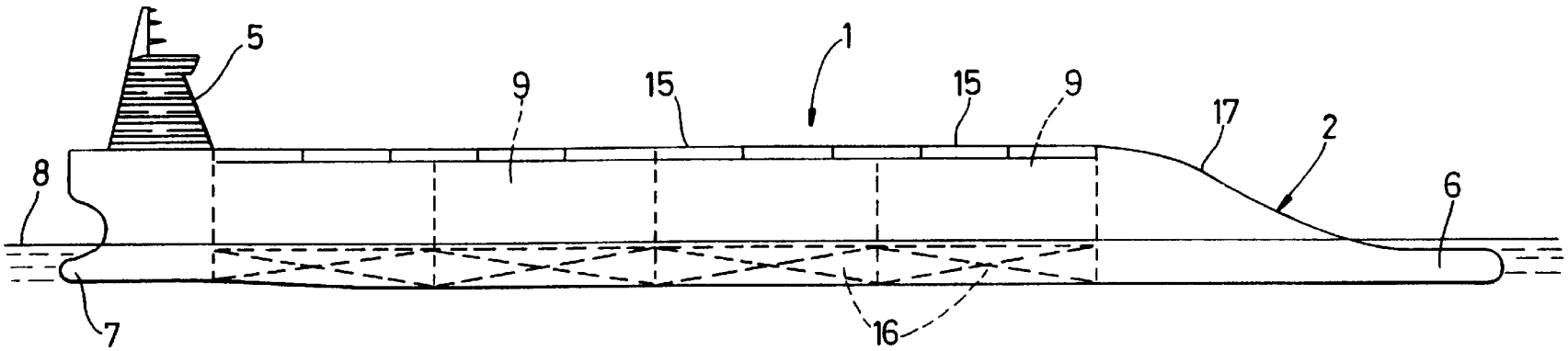
FIG. 1 is a side view of a first form of marine vessel.
Figure 2:
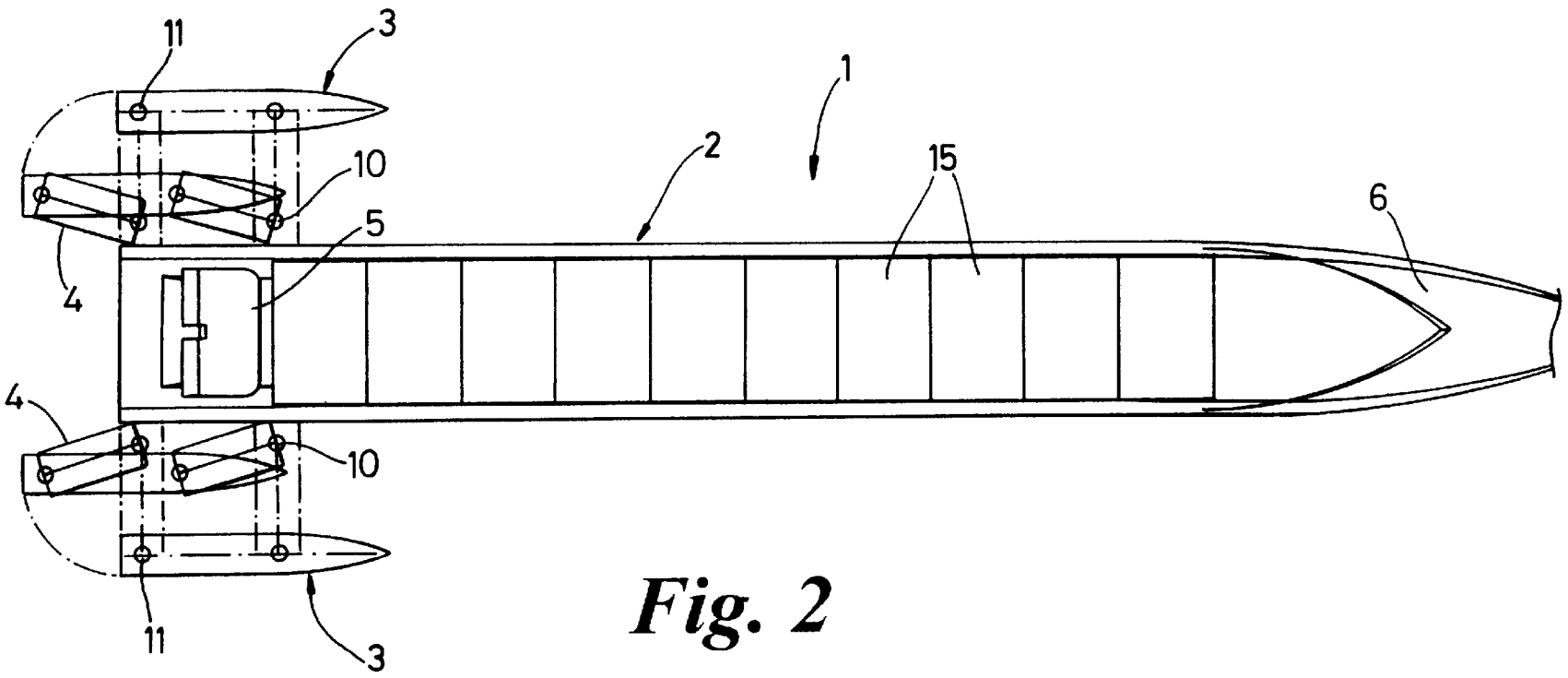
FIG. 2 is a plan view thereof.

With reference to FIGS. 1 and 2, a marine vessel in the form of a freight ship 1 comprises a central hull 2 stabilised by a pair of outboard sponsons 3 flanking the stern end of the hull 2.

The hull 2 has a waterline length to beam ratio greater than 6. In this example, the ratio is 10. The waterline is shown at 8.

The sponsons 3 are pivotally attached to the stern end of the hull 2 by bridging structures 4 which are movable sternwards, relative to the hull, in a pantograph-like manner, so as to enable the hull to be manoeuvred close to a quay or like structure for hull loading/unloading operations.

The pivot points for the sponsons 3 are shown at 10 and 11, whereby the sponsons fold about substantially vertical axes.

The hull 2 carries a bridge accommodation superstructure 5 and has bulbous bow 6 and stern 7 structures.

The hull 2 defines four freight-carrying spaces in the form of cargo holds 9, with hatch covers 15, intended to accommodate cargo containers.

Alternatively, only a single freight carrying space may be provided if the marine vessel is to operate as a Roll-on Roll-off (RORO) ship.

The hull 2 is also formed with double-bottom tanks 16.

The sponsons 3 preferably have a waterline length of not more than 30% of the waterline length of the hull.

Details of the vessel 1 are as follows:

Overall length: 250 meters

Waterline length: 220 meters

Waterline width (of hull 2): 22 meters

Hull waterline length to beam ratio: 10

Waterline length of each sponson 3: 39 meters, i.e. 18% of hull waterline length Waterline beam of each sponson 3: 6 meters Containerised cargo: 1000 cargo containers (each 6.096×2.438×2.438 meters) Total length of cargo holds 9: 150 meters.

Propulsion and steering means for the vessel 1 are preferably carried by the sponsons 3. The propulsion means so carried may comprise:

a) water-screw propellers, driving machinery therefor, and rudders, b) steerable water jet units, driving machinery therefor, c) water screw propellers, electric drive motors therefor, supplied with electrical current by generators either disposed in the sponsons, or alternatively, in the hull 2, plus rudders.

Whatever form of vessel propulsion and steering means may be chosen, the object should be to keep the stern of the hull 2 free of water-screw propellers and rudders, and to avoid the employment of propulsion machinery in the hull itself. Electrical generating equipment for diesel electric propulsion may be carried by the hull 2, but this can be disposed on the hull deck, leaving the hull free to accommodate freight.

The stern end of the hull 2 is also free to be shaped so as to have a form whereby resistance is substantially reduced, compared with a conventional vessel provided with a water-screw and a rudder.

Use of both bow and stern bulbous sections also reduces wave-making resistance by creating wave-cancelling pressure fields at the bow and stern of the hull 2.

In the example illustrated, the bulbous bow 6 is larger and projects further forward than on most conventional vessels, and is faired upwardly and sternwards, back into the hull 2, as shown at 17. This creates a fore-body which tends to run through waves rather than responding to them and causing the vessel to pitch.

The design also enables use of a stern bulbous section larger than employed conventionally.

Folding back of the sponsons 3 may cause the vessel 1 to become unstable. To avoid instability, water may be introduced into the double bottom tanks 16, to serve as ballast. The water is subsequently discharged when the sponsons 3 are restored to their normal, ie extended positions.

Figure 3:
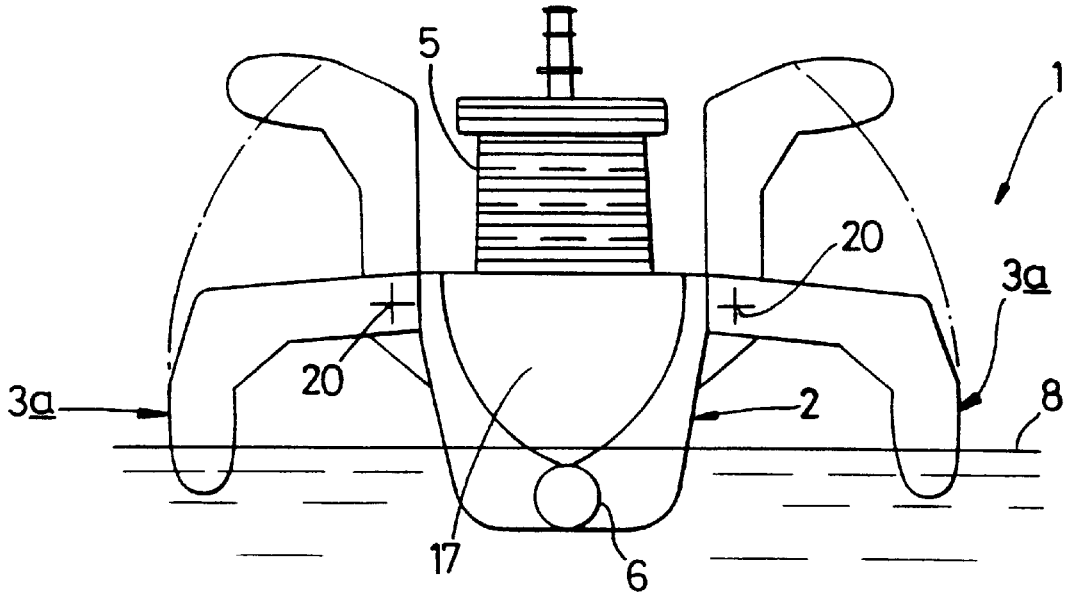
FIG. 3 is a bow-end view which illustrates a modification.

With reference to FIG. 3, the vessel 1 may be provided with sponsons 3*a* movable about substantially horizontal axes 20 between inoperative (raised) and operative (lowered) positions.

Figure 4:
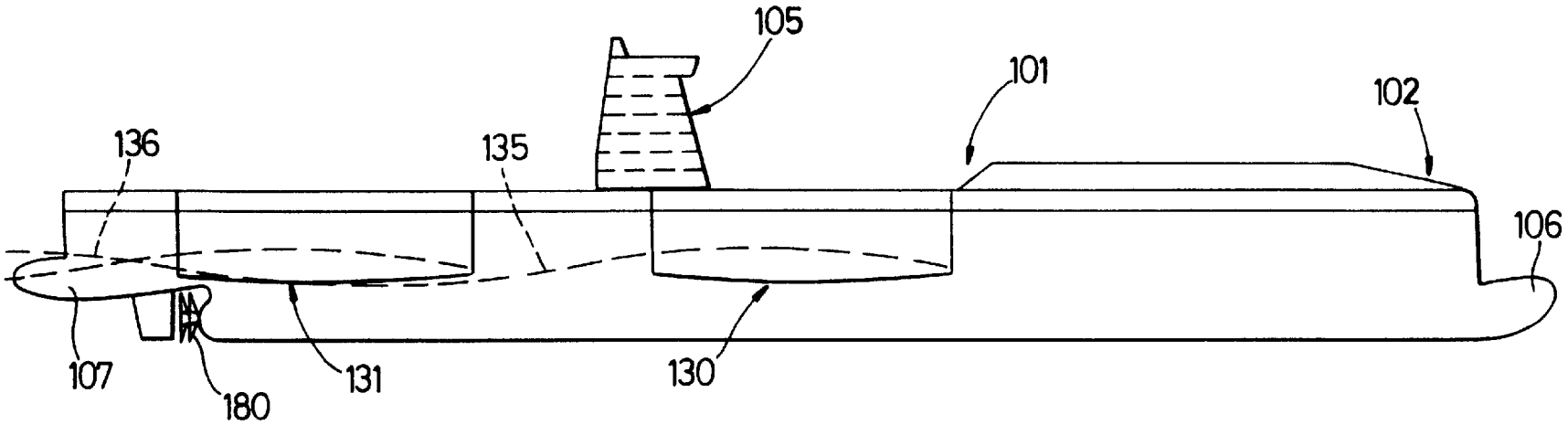
FIG. 4 is a side view of a second form of marine vessel.
Figure 5:
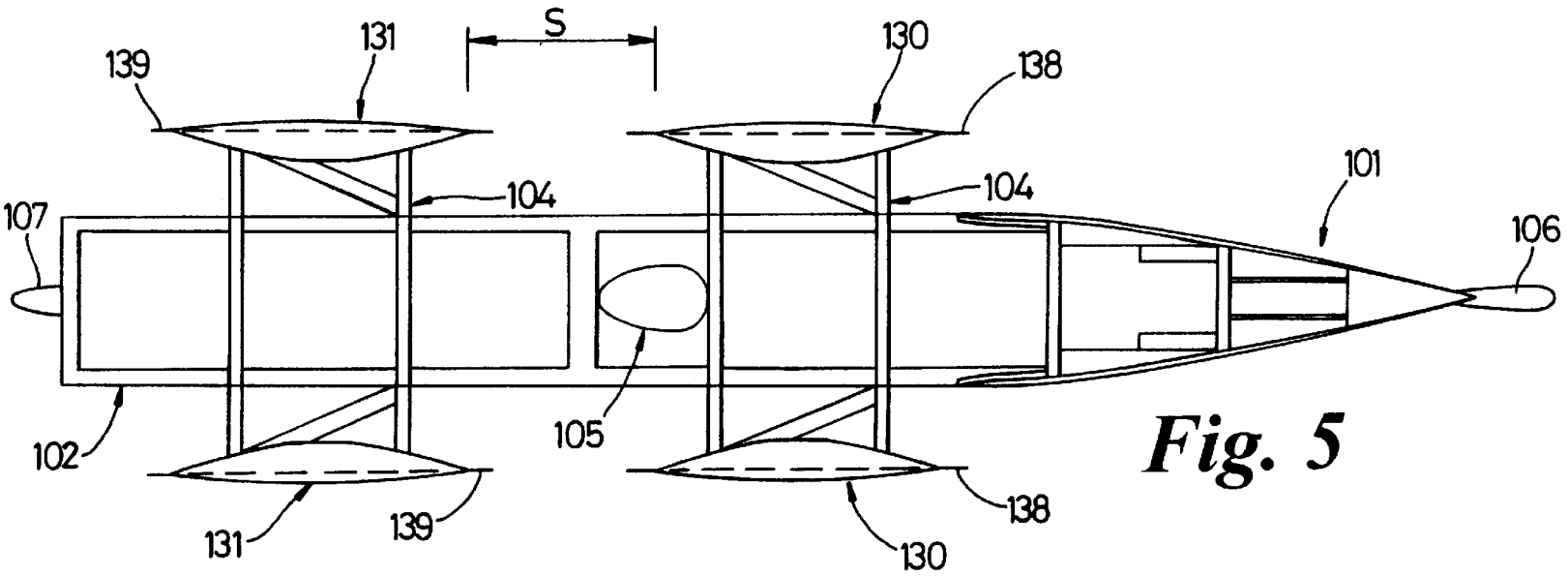
FIGS. 5 and 6 are plan views thereof.

With reference now to FIGS. 4 and 5, a marine vessel in the form of a freight ship 101 comprises a central hull 102 stabilised by two pairs of outboard sponsons 130, 131 flanking the stern-end midship portions of the hull 102.

The hull 102 has a waterline length to beam ratio greater than 6. In this example the ratio is 10. The length to beam ratio may be substantially higher than 10 for a faster marine vessel.

The sponsons 130, 131 are attached to the hull 102 by fixed (ie non-folding) bridging structures 104 so as to enable the marine vessel 101 to be manoeuvred fairly close to a quay or like structure for hull loading/unloading operations. (Container cranes generally have an outreach of about 40 meters.)

If desirable, the bridging structures 104 may be made foldable.

The first and second pairs of sponsons 130, 131 of this example are disposed one behind the other, as best seen in FIG. 5. The sponsons of each pair are disposed laterally of each other. The sponsons 131 of the second pair are aligned with the sponsons 130 of the first pair, and spaced longitudinally therefrom, whereby the wave trains 135 of the first pair of sponsons 130 beneficially interfere with the wave trains 136 of the second pair of sponsons 131 so as to reduced wave resistance.

The longitudinal spacing S of the sponson pairs 130, 131 is such that the wave trains generated by the leading sponsons 130 are substantially 180° out of phase with the wave trains 136 generated by the trailing sponsons 131. Thus the peaks of wave trains 135 interfere with the troughs of wave trains 136 whereby wave-making resistance is substantially reduced.

As a general rule, faster marine vessels would employ larger longitudinal spacings of sponson pairs than slower ships.

Each fore and aft pair of longitudinally aligned sponsons 130, 131 are positioned relative to the central hull 102 so as to allow beneficial interference between the nett wave-making generated by the sponson and the wave-making generated by the hull 102.

The sponsons 130, 131 need not be disposed in alignment in order to achieve wave train interference.

The hull 102 carries a bridge accommodation superstructure 105 and has bulbous bow 106 and bulbous stern 107 structures.

The hull 102 defines freight-carrying spaces (not shown) in the form of cargo holds intended to accommodate cargo containers.

Alternatively, only a single freight carrying space may be provided if the marine vessel is to operate as a Roll-on Roll-off (RORO) ship.

The hull 102 is also formed with the usual double-bottom tanks.

Figure 6:
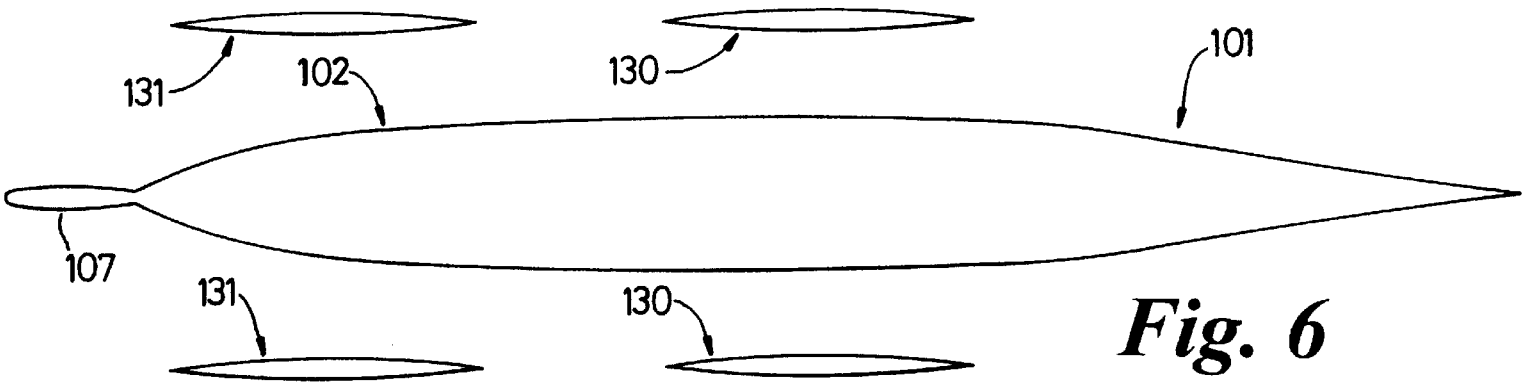
Figure 7:
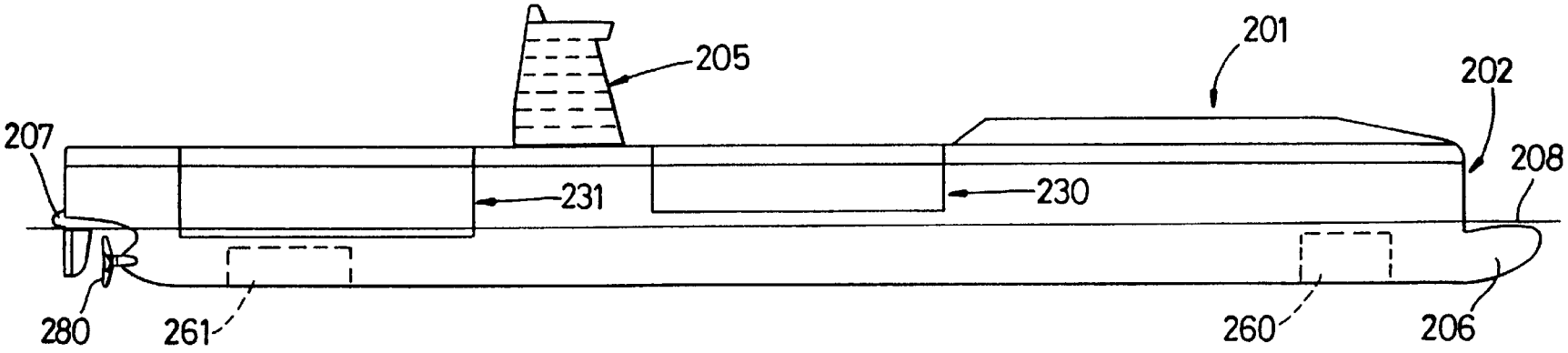
FIG. 7 is a side view of a third form of marine vessel.

The sponsons 130, 131 preferably have a waterline length of not more than 30% of the waterline length of the central hull 102. FIG. 6 comprises a plan view at the waterline.

Details of the vessel 101 are as follows:

| | |
|---|---|
| Overall length | 250 meters |
| Waterline length | 220 meters |
| Waterline width (of hull 102) | 22 meters |
| Hull waterline length to beam ratio | 39 meters, i.e. 18% of hull waterline length |
| Waterline beam of each sponson 130, 131 | 2.6 meters |
| Waterline length of each sponson 130, 131 | 48 meters |
| Containerised cargo | 1200 cargo containers (each 6.096 × 2.438 × 2.438 meters |
| Total length of cargo holds 9 | 150 meters |

Propulsion and steering means for the vessel 101 carried by the sponsons 130, 131 may comprise propulsion and steering means as described above, with reference to the marine vessel 1 of FIGS. 1 and 2. However, propulsion engines are preferably located in the central hull 102 and drive a contra-rotatable propeller 180.

In a modification of the marine vessel illustrated by FIGS. 4, 5 and 6 the vessel may be converted to a catamaran type vessel. This is achieved, in effect, by removal of the central hull 102.

The shapes of the bulbous bows 6, 106 may vary according to requirements. For example, the bulbous bow 106 is non-faired, and the bottom of the bow extends upwardly and forwardly.

With reference now to FIGS. 7 to 14, a marine vessel in the form of a freight ship 201 comprises a single, central hull 202 (of waterline length to beam ratio grater than 6 and, as illustrated, about 10) stabilised by first and second pairs of outboard-disposed buoyant sponsons 230, 231.

The sponsons 230 of the first pair are disposed at a higher level than the sponsons 231 of the second pair so that, at the load water line 208 of the vessel hull 202, the sponsons 231 of the second pair are in immersed contact with the water level 252 (FIGS. 9 to 14) at water line 208, while the sponsons 230 of the first pair are (normally) disposed above the water 252 at waterline 208. As explained hereinafter with reference to FIGS. 9 to 14, should the vessel heel to one side, the sponson 230 of the first pair on the heeling or downgoing side of the vessel is brought into contact with the water 252 so as to create an upwardly-acting restoring force 250 which tends to stabilise the vessel 201.

The marine vessel 201 is of substantially the same form and dimensions of the marine vessel 101 of FIGS. 4 to 6 and thus requires little further explanation, except in respect of the sponsons 230, 231.

However, the vessel 201 is provided with fore and aft ballast tanks 260, 261 whereby the vessel is trimmed so as to ensure that the sponsons 230, 231 are disposed where required, relative to the water line 208.

The sponsons 230, 231, which have a waterline length of not more than 30% of the waterline length of the central hull 202, are spaced from each other longitudinally of the marine vessel 201 as indicated at S. The sponsons 230, 231 are also spaced outboard of the centrally-disposed hull 202, being connected thereto by bridging structure 204, which in this example is non-foldable, but may be replaced by foldable structure.

The sponsons 230, 231 and non-foldable bridging structure 204, may be covered with decking 251 (FIG. 8) which may be extended in area beyond that illustrated.

Figure 8:
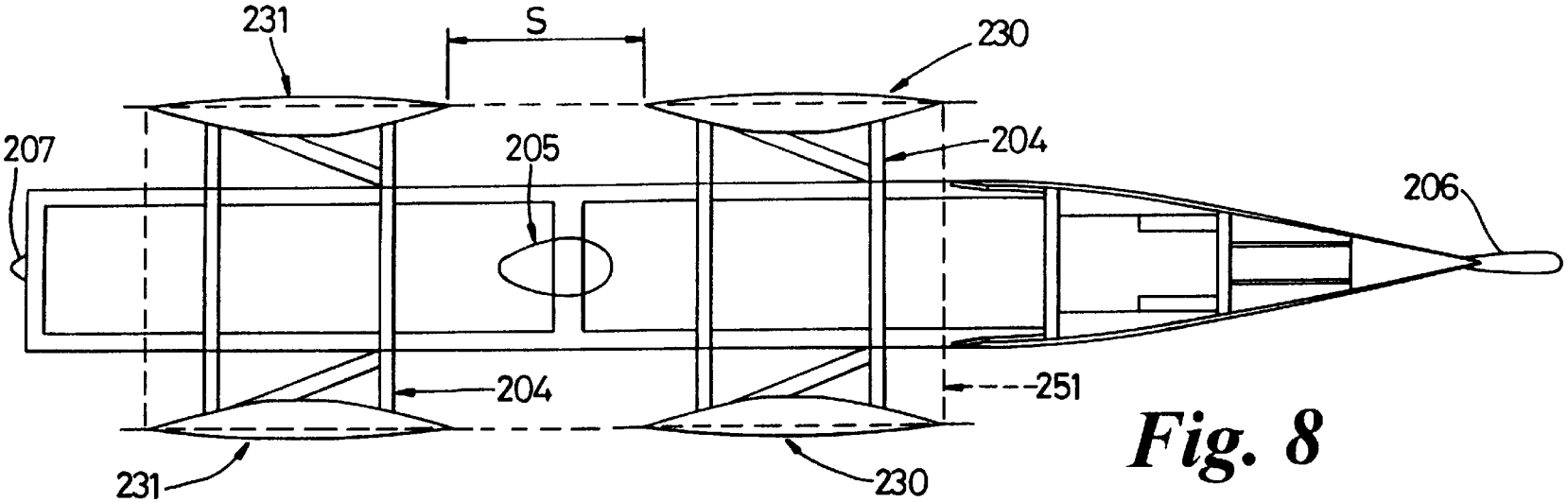
FIG. 8 is a plan view thereof.

As in the case of FIG. 5, the sponsons 230 of the first pair of sponsons are aligned with the sponsons 231 of the second pair thereof (FIG. 8 refers).

Figures 9, 10, 11, 12, 13, 14:
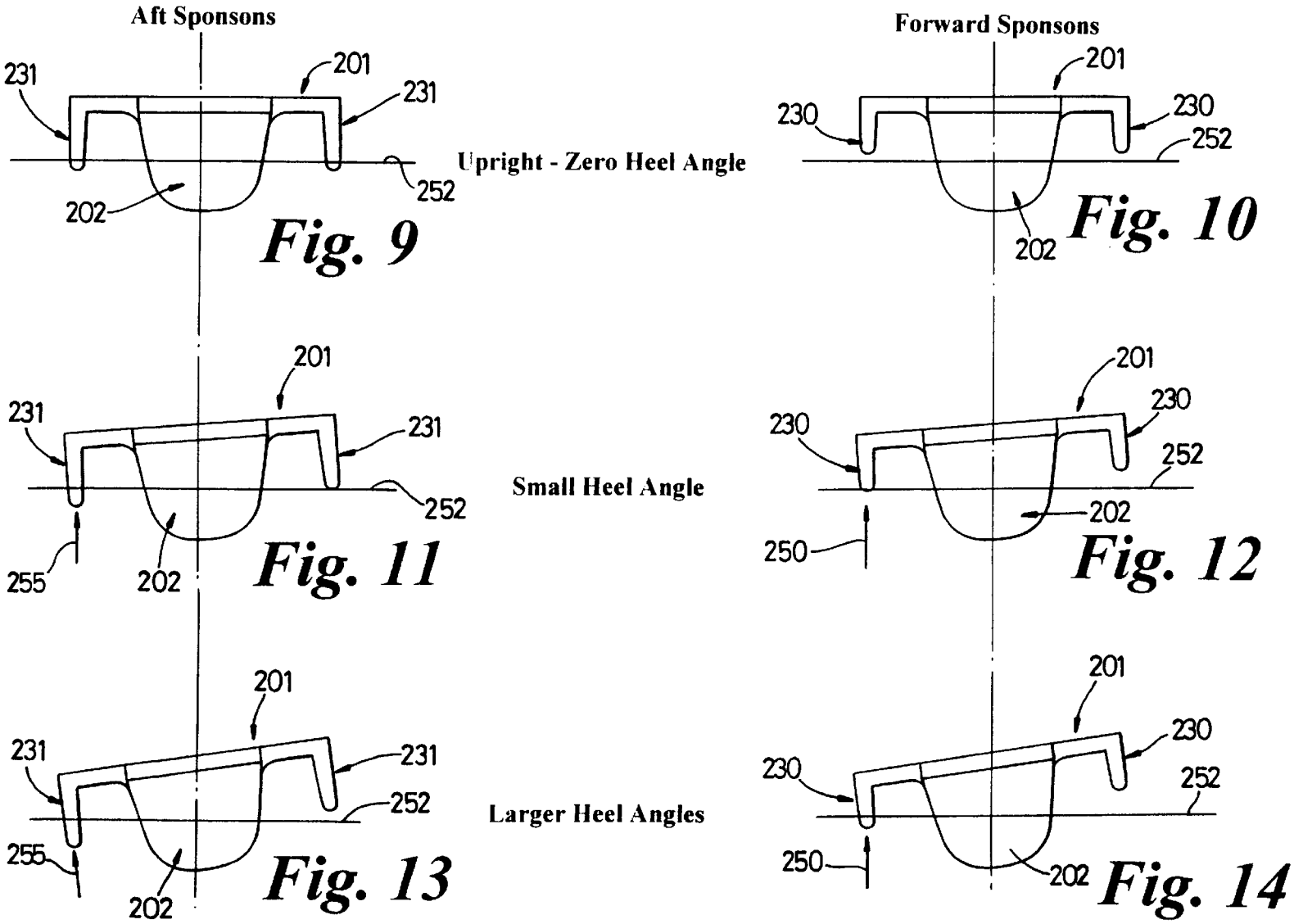
FIGS. 9 to 14 are front views which illustrate the behaviour of the sponsons of the vessel at various heel angles.

FIGS. 9 to 14 illustrate what happens during progressive heeling of the marine vessel 201. FIGS. 9, 11 and 13 show the action of the aft-disposed sponsons 231 and FIGS. 10, 12 and 14 show the action of the forward-disposed sponsons 230.

It will be seen from these figures that at zero heel angle, the waterline breadth of each rearward sponson 231 is greater than the draft thereof (FIG. 9 refers).

With reference first to FIGS. 9 and 10, these figures show the positions of the forward and aft-disposed sponsons 230, 231 respectively, at zero heel angle, that is with the hull 202 upright. In these positions, the bottoms of the relatively low sponsons 231 are immersed in the water 252, thus providing the vessel 201 with initial stability, while the bottoms of the relatively high sponsons 230 are clear of the water 252.

FIGS. 11 and 12 show the marine vessel 201 disposed at a small angle of heel. The aft-disposed sponson 231 (FIG. 11) on the heeling or downgoing side of the hull 202 now dips deeper into the water 252 while the aft-disposed sponson 231 on the upgoing side of the hull emerges from contact with the water. The forwardly-disposed sponson 230 (FIG. 12) on that downgoing side is simultaneously brought into contact with the water. This creates an upwardly-acting restoring force 250 on the downgoing sponson 230, which tends to stabilise the vessel 201.

The restoring force 250 is assisted by a similar force 255 created as the downgoing sponson 231 dips deeper into the water 252.

At a larger angle of heel, illustrated by FIGS. 13 and 14, the downgoing aft-disposed sponson 231 is immersed further into the water 252 while the upgoing sponson 231 of the pair is pulled clear of the water.

At the same time, the downgoing and upgoing forwardly-disposed sponsons 230 are immersed deeper into the water 252 and drawn further away from the water 252 respectively.

Figure 15:
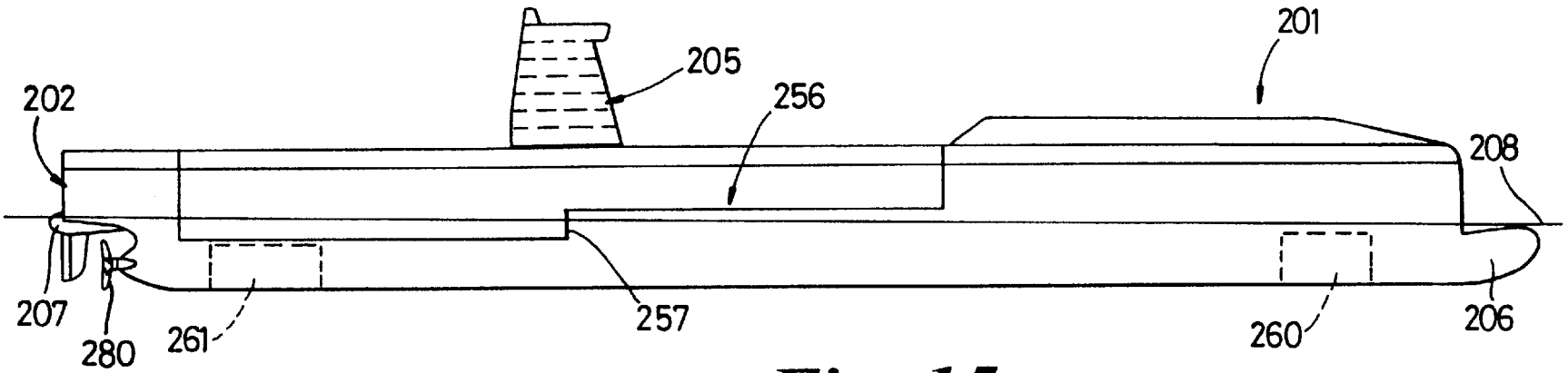
FIGS. 15 and 16 are side views which illustrate modifications.

FIG. 15 illustrates a modification wherein the first and second pairs of sponsons 230, 231 are combined into a single integral or unitary structure 256 of stepped form.

Figure 16:
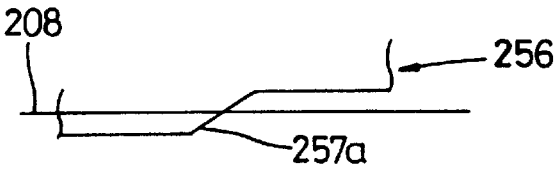

The step 257 is abrupt, in FIG. 15, but with reference to the modification illustrated by FIG. 16, a structure 256 may be profiled so as to have a rearwardly-sloping step 257*a*, whereby wave-impact forces are reduced.

The forwardly-disposed sponsons 230 will also come into play should the marine vessel 201 be subjected to pitching forces.

Where possible, and where desirable, any of the above-described features may be substituted for, or added to, each other.

Although mono-hull marine vessels have been described herein, the various aspects of the invention are not to be restricted thereto, as they are also applicable to multi-hull marine vessels.

Similarly, although freight vessels have been described herein, the various aspects of the invention are also applicable to car ferries, with the following advantages compared with presently-known car ferries:

a) lower propulsive power
b) better vessel motion control
c) lower construction costs
d) wide deck area (decking 251 and extensions thereof)
e) possible use of heavier, more efficient engine machinery, due to lower weight sensitivity.

With reference to FIGS. 5 to 16 it will be noted that, in the case of a two pair sponson arrangement, at least part of each forward sponson 130, 230 is beneficially disposed in the stern half of the associated hull 102, 202.

We claim:

1. A marine vessel comprising a central hull stabilised by first and second pairs of outboard sponsons and propelled by propulsion means, first pair of sponsons being disposed forwardly of the second pair of sponsons, the sponsons of the first pair being disposed at a higher level than the sponsons of the second pair so that, at zero heel angle, at the load water line of the vessel, the sponsons of the second pair are in contact with the water while the sponsons of the first pair are disposed above the water, whereby, at zero heel angle, the waterline breadth of each sponson of the second pair of sponsons is greater than the draft thereof, and that should the vessel heel to one side, the sponson of the second pair on the downgoing side of the vessel dips deeper into the water, while the other sponson of the second pair which is on the upgoing side of the vessel emerges from contact with the water, and the sponson of the first pair on the downgoing side of the vessel is simultaneously brought into contact with the water, so as to stabilise the vessel.

2. A marine vessel as claimed in claim 1 wherein the hull is for carrying payload.

3. A marine vessel as claimed in claim 2, wherein the hull has a waterline length to beam ratio greater than 6.

4. A marine vessel as claimed in claim 3, wherein the hull defines at least one freight carrying space.

5. A marine vessel as claimed in claim 1, wherein the sponsons of each pair of first and second sponsons are spaced from each other longitudinally (by distance S) of the vessel.

6. A marine vessel as claimed in claim 1, wherein the pairs of sponsons are covered by deck structure.

7. A marine vessel as claimed in claim 1, wherein the waterline length of each sponson (eg 3) is not more than 30% of the waterline length of the vessel hull.

8. A marine vessel as claimed in claim 1, wherein the sponsons of each pair are spaced laterally from each other, the sponsons of the second pair being spaced longitudinally (by distance S) from the sponsons of the first pair, whereby the wave trains of the first pair of sponsons interfere with the wave trains of the second pair of sponsons, so as to reduce wave resistance.

9. A marine vessel as claimed in claim 8, wherein the peaks of the wave trains of the first pair of sponsons interfere with the troughs of the wave trains of the second pair of sponsons.

10. A marine vessel as claimed in claim 1, wherein one pair of sponsons is disposed at the stern end of the hull.

11. A marine vessel as claimed in claim 1 wherein the propulsion means are carried by the sponsons.

12. A marine vessel as claimed in claim 1 wherein the propulsion means are carried by the hull.

13. A marine vessel comprising a central hull stabilized by first and second pairs of outboard sponsons and propelled by propulsion means, the first pair of sponsons being disposed forwardly of the second pair of sponsons, wherein the sponsons of each pair of first and second sponsons are combined so as to form a single integral structure of stepped form, the sponsons of the first pair being disposed at a higher level than the sponsons of the second pair so that, at zero heel angle, at the load water line of the vessel, the sponsons of the second pair are in contact with the water while the sponsons of the first pair are disposed above the water, wherein, at zero heel angle, the waterline breadth of each sponson of the second pair of sponsons is greater than the draft thereof, and wherein should the vessel heel to one side, the sponson of the second pair on the downgoing side of the vessel dips deeper into the water, while the other sponson of the second pair which is on the upgoing side of the vessel emerges from contact with the water, and the sponson of the first pair on the downgoing side of the vessel is simultaneously brought into contact with the water, so as to stabilize the vessel.

14. A marine vessel as claimed in claim 13, wherein the step slopes rearwardly.

15. A marine vessel comprising a central hull for carrying a payload and stabilized by first and second pairs of outboard sponsons and propelled by propulsion means, the first pair of sponsons being disposed forwardly of the second pair of sponsons, wherein the hull has a waterline length to beam ratio of at least 10, the sponsons of the first pair are disposed at a higher level than the sponsons of the second pair so that, at zero heel angle, at the load water line of the vessel, the sponsons of the second pair are in contact with the water while the sponsons of the first pair are disposed above the water, wherein, at zero heel angle, the waterline breadth of each sponson of the second pair of sponsons is greater than the draft thereof, and wherein should the vessel heel to one side, the sponson of the second pair on the downgoing side of the vessel dips deeper into the water, while the other sponson of the second pair which is on the upgoing side of the vessel emerges from contact with the water, and the sponson of the first pair on the downgoing side of the vessel is simultaneously brought into contact with the water, so as to stabilize the vessel.

16. A marine vessel comprising a central hull stabilized by first and second pairs of outboard sponsons and propelled by propulsion means, the first pair of sponsons being disposed forwardly of the second pair of sponsons, wherein the sponsons are moveable relative to the vessel hull, wherein the sponsons of the first pair are disposed at a higher level than the sponsons of the second pair so that, at zero heel angle, at the load water line of the vessel, the sponsons of the second pair are in contact with the water while the sponsons of the first pair are disposed above the water, wherein, at zero heel angle, the waterline breadth of each sponson of the second pair of sponsons is greater than the draft thereof, and wherein should the vessel heel to one side, the sponson of the second pair on the downgoing side of the vessel dips deeper into the water, while the other sponson of the second pair which is on the upgoing side of the vessel emerges from contact with the water, and the sponson of the first pair on the downgoing side of the vessel is simultaneously brought into contact with the water, so as to stabilize the vessel.

17. A marine vessel comprising a central hull stabilized by first and second pairs of outboard sponsons and propelled by propulsion means, the first pair of sponsons being disposed forwardly of the second pair of sponsons and the sponsons of the second pair being aligned with the sponsons of the first pair, the sponsons of the first pair being disposed at a higher level than the sponsons of the second pair so that, at zero heel angle, at the load water line of the vessel, the sponsons of the second pair are in contact with the water while the sponsons of the first pair are disposed above the water, wherein, at zero heel angle, the waterline breadth of each sponson of the second pair of sponsons is greater than the draft thereof, and wherein should the vessel heel to one side, the sponson of the second pair on the downgoing side of the vessel dips deeper into the water, while the other sponson of the second pair which is on the upgoing side of the vessel emerges from contact with the water, and the sponson of the first pair on the downgoing side of the vessel is simultaneously brought into contact with the water, so as to stabilize the vessel.

18. A marine vessel comprising a central hull stabilized by first and second pairs of outboard sponsons and propelled by propulsion means, the first pair of sponsons being disposed forwardly of the second pair of sponsons, at least part of each forward sponson being disposed in the stem half of the hull, the sponsons of the first pair being disposed at a higher level than the sponsons of the second pair so that, at zero heel angle, at the load water line of the vessel, the sponsons of the second pair are in contact with the water while the sponsons of the first pair are disposed above the water, wherein, at zero heel angle, the waterline breadth of each sponson of the second pair of sponsons is greater than the draft thereof, and wherein should the vessel heel to one side, the sponson of the second pair on the downgoing side of the vessel dips deeper into the water, while the other sponson of the second pair which is on the upgoing side of the vessel emerges from contact with the water, and the sponson of the first pair on the downgoing side of the vessel is simultaneously brought into contact with the water, so as to stabilize the vessel.

* * * * *

UNITED STATES PATENT AND TRADEMARK OFFICE

CERTIFICATE OF CORRECTION

PATENT NO. : 6,044,784

DATED : April 4, 2000

INVENTOR(S) : Gee et al.

It is certified that error appears in the above-identified patent and that said Letters Patent is hereby corrected as shown below:

Title Page, Item [56] References Cited, U.S. PATENT DOCUMENTS: "5,277,142 1/1994 Conor" should read -- 5,277,142 1/1994 Connor --;

Column 6, line 6: "first" should read -- the first --;

Column 8, line 18: "stem" should read -- stern --.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*